US007289036B2

(12) United States Patent
Salzhauer et al.

(10) Patent No.: US 7,289,036 B2
(45) Date of Patent: Oct. 30, 2007

(54) PERSONAL ALARM DEVICE

(76) Inventors: Michael Alexander Salzhauer, 9241 Byron Ave., Surfside, FL (US) 33154; Leora Sarah Salzhauer, 165 Cowpens Dr., Orangeburg, NY (US) 10962

( * ) Notice: Subject to any disclaimer, the term of this patent is extended or adjusted under 35 U.S.C. 154(b) by 421 days.

(21) Appl. No.: 10/382,865

(22) Filed: Mar. 7, 2003

(65) Prior Publication Data

US 2004/0135699 A1 Jul. 15, 2004

Related U.S. Application Data

(60) Provisional application No. 60/440,052, filed on Jan. 15, 2003.

(51) Int. Cl.
*G08B 25/08* (2006.01)

(52) U.S. Cl. ..... 340/692; 340/539.1; 340/540; 340/573.1; 340/691.3

(58) Field of Classification Search ..... 340/692, 340/539.1, 539.11, 691.3, 573.1, 626, 632, 340/286.05, 540
See application file for complete search history.

(56) References Cited

U.S. PATENT DOCUMENTS 3,952,294 A 4/1976 Emerson et al.
4,093,944 A * 6/1978 Muncheryan ..... 340/521
4,160,246 A 7/1979 Martin et al.
4,363,031 A 12/1982 Reinowitz
4,410,883 A 10/1983 Swiston, Sr.
4,453,222 A 6/1984 Goszyk
4,617,555 A 10/1986 Sheiman
4,623,878 A 11/1986 Schoenwetter
4,893,324 A 1/1990 Scown
4,896,145 A 1/1990 Lewkowicz
4,904,988 A * 2/1990 Nesbit et al. ..... 340/628
5,019,805 A 5/1991 Curl et al.
5,159,315 A 10/1992 Schultz et al.
5,349,338 A * 9/1994 Routman et al. ..... 340/692
5,423,327 A * 6/1995 Clauson et al. ..... 600/322
5,587,705 A 12/1996 Morris
5,594,422 A 1/1997 Huey, Jr. et al.
5,625,345 A 4/1997 Stark et al.
5,651,070 A 7/1997 Blunt
5,663,714 A * 9/1997 Fray ..... 340/692
5,710,803 A * 1/1998 Kowal et al. ..... 379/41
5,726,629 A 3/1998 Yu
5,889,468 A 3/1999 Banga
6,002,921 A 12/1999 Phahlert et al.
6,028,513 A * 2/2000 Addy ..... 340/539.16

(Continued)

*Primary Examiner*—Davetta W. Goins
(74) *Attorney, Agent, or Firm*—David W. Barman; Robert M. Schwartz

(57) ABSTRACT

In accordance with embodiments of the present invention, a method for alerting a quiescent person, may include recording a personal alert message, receiving an alarm over a wireless communications link, and, in response to the alarm, playing the personal alert message. In accordance with other embodiments of the present invention, a device for alerting a quiescent person may include an audio input to record a personal alert message, a memory to store the personal alert message, an audio output to play the personal alert message, a wireless receiver to receive an alarm, a power supply and a processor, coupled to the audio input, the audio output, the memory, the wireless receiver and the power supply. The processor may be adaptively configured to receive an alert signal from the wireless receiver, and in response to the alert signal, send a play signal to play the personal alert message.

22 Claims, 2 Drawing Sheets

U.S. PATENT DOCUMENTS 6,043,750 A 3/2000 Mallory
6,052,052 A * 4/2000 Delmonaco ..... 340/539.1
6,078,269 A 6/2000 Markwell et al.
6,084,522 A 7/2000 Addy
6,087,933 A * 7/2000 Addy et al. ..... 340/539.24
6,097,288 A 8/2000 Koeppe, Jr.
6,239,704 B1 5/2001 Olson
6,310,554 B1 * 10/2001 Carrell ..... 340/601
6,323,780 B1 11/2001 Morris
6,377,172 B1 * 4/2002 Neer ..... 340/539.1
6,380,860 B1 4/2002 Goetz
6,384,724 B1 5/2002 Landais
6,392,536 B1 5/2002 Tice et al.
6,420,973 B2 7/2002 Acevedo
6,441,731 B1 8/2002 Hess
6,518,878 B1 2/2003 Skoff
6,522,248 B1 2/2003 Andres et al.
6,529,128 B2 * 3/2003 Weng ..... 340/539.1
6,690,288 B1 2/2004 Waddell
6,768,424 B1 * 7/2004 Morris ..... 340/628
6,836,212 B2 12/2004 Sawinski
6,838,994 B2 * 1/2005 Gutta et al. ..... 340/575
6,967,900 B2 * 11/2005 Chapman ..... 368/10

* cited by examiner

PERSONAL ALARM DEVICE

CLAIM FOR PRIORITY

This non-provisional patent application claims the benefit of U.S. Provisional Patent Application Ser. No. 60/440,052, filed Jan. 15, 2003, which is incorporated by reference in its entirety.

TECHNICAL FIELD

The present invention relates to a device and method for alerting a quiescent person to the presence of a dangerous condition.

BACKGROUND OF THE INVENTION

Smoke, and gas, detectors are lifesaving devices that greatly increase the likelihood of surviving a fire in a building. Generally, these detection devices sense smoke, carbon dioxide or other noxious and toxic airborne substances, and, in response, sound a piercing alarm, or flash an intense strobe light, to alert the occupants of the building to the dangerous condition. For residential structures, the occupants may be sleeping and difficult to rouse. For example, young children often fail to wake during mock fire drills, due, in part, to their ability to fall asleep even in the noisiest environments. Older adults may also be insensitive to external environmental queues when sleeping.

The standard smoke detector's audible alarm often fails to wake these individuals quickly enough to avoid injury. In a building fire, or in other dangerous conditions, a device that quickly and consistently wakes up sleeping occupants may mean the difference between life and death.

DETAILED DESCRIPTION

In accordance with embodiments of the present invention, a method for alerting a quiescent person may include recording a personal alert message, receiving an alarm over a wireless communications link, and, in response to the alarm, playing the personal alert message. In accordance with other embodiments of the present invention, a device for alerting a quiescent person may include an audio input to record a personal alert message, a memory to store the personal alert message, an audio output to play the personal alert message, a wireless receiver to receive an alarm, a power supply and a processor, coupled to the audio input, the audio output, the memory, the wireless receiver and the power supply. The processor may be adaptively configured to receive an alert signal from the wireless receiver, and in response to the alert signal, send a play signal to play the personal alert message.

Figure 1:
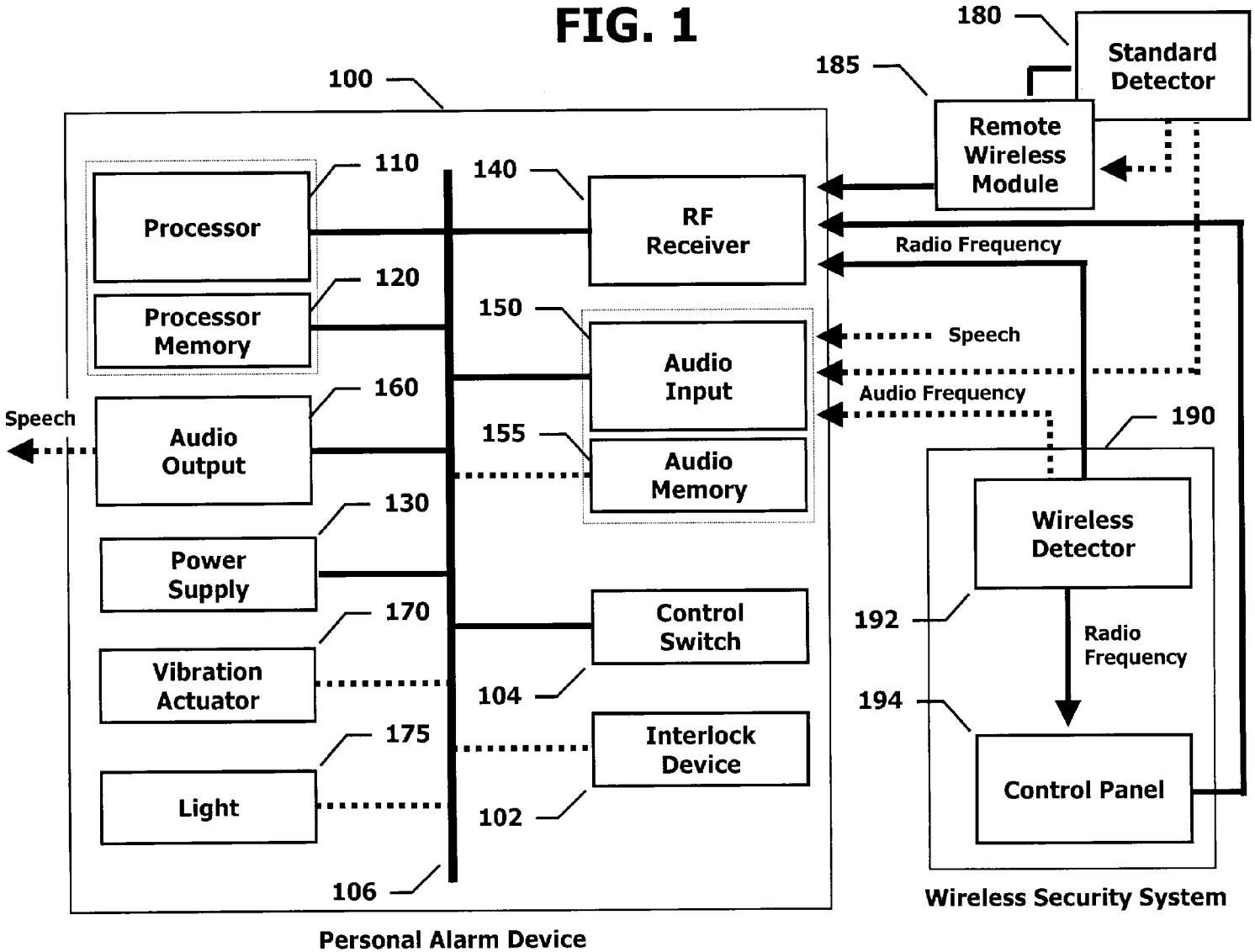
FIG. 1 is a schematic representation of a personal alarm device, according to an embodiment of the present invention.

FIG. 1 is a schematic representation of a personal alarm device, according to an embodiment of the present invention.

In an embodiment, personal alarm device 100 may include bus 106 coupled to processor 110, processor memory 120, power supply 130, radio-frequency (RF) receiver 140, audio input 150, audio output 160 and at least one control switch 104. In another embodiment, bus 106 may also be coupled to audio memory 155 and interlock device 102. Generally, bus 106 may include a plurality of couplings that provide electrical connections between the various components of personal alarm device 100, such as point-to-point connections (e.g., printed circuit board traces, wire runs, etc.), address, data and/or control buses, etc. In a further embodiment, personal alarm personal alarm device 100 may also include vibration actuator 170, which may be coupled to bus 106. In an additional embodiment, personal alarm device 100 may also include light 175, which may be coupled to bus 106. Generally, personal alarm device 100 may be located in close proximity to, or in physical contact with, the quiescent person, and may be incorporated within various structures, such as, for example, a wristband, a stuffed animal, a pillow, a blanket, a comforter, a mattress, etc.

Processor 110 may be a microcontroller, such as a Microchip PIC16F628 Device (manufactured by Microchip Technology, Inc. of Chandler, Ariz.), a microprocessor, such as an Intel® compatible microprocessor, an Application Specific Integrated Circuit (ASIC), etc. Processor memory 120 may include non-volatile and/or volatile memory, such as, for example, Flash EPROM, EEPROM, PEROM, DRAM, SRAM, etc. In one embodiment, processor memory 120 may be a standalone device coupled to bus 106, such as an AMD Flash 29F Flash Memory Device (manufactured by AMD of Sunnyvale, Calif.), while in another embodiment, processor memory 120 may be included within processor 110 (i.e., on-chip). For example, the Microchip PIC16F268 Device includes on-chip FLASH program memory as well as on-chip EEPROM data memory. Generally, processor memory 120 may include instructions adapted to be executed by processor 110 to perform methods associated with embodiments of the present invention, and at least some portion of processor memory 120 may be write-enabled.

Generally, power supply 130 provides DC power, at the appropriate voltages and currents, to the appropriate components of personal alarm device 100. In an embodiment, power supply 130 may include a battery, voltage regulator, power control circuitry, power switch, etc., to provide one or more supply voltages, such as, for example, 9V, 5V, etc.

Radio-frequency receiver 140 may be coupled to an antenna, and may receive and decode a radio-frequency alarm message. In one embodiment, radio-frequency receiver 140 may include an integrated, receiver-decoder module, such as, for example, a Linx RXD-418-KH Receiver/Decoder (manufactured by Linx Technologies of Grants Pass, Oreg.), etc. In response to the radio-frequency alarm message, radio-frequency receiver 140 may send an alert signal, via bus 106, to processor 110.

In one embodiment, audio input 150 may include a microphone and associated analog-to-digital (A/D) and digital signal processing (DSP) circuitry to capture an analog acoustic signal, e.g., voice or speech representing a personal alert message, convert the analog acoustic signal to digitized speech, and send the digitized speech, via bus 106, to processor 110. Processor 110 may then store the digitized speech in processor memory 120. Additionally, control switch 104 may be coupled to bus 106 to provide a signal to processor 110, or directly to audio input 150, to initiate the speech acquisition process. Once initiated, the speech acquisition process may extend for a predetermined time, such as, for example, 10 seconds, 20 seconds, 30 seconds, etc.

Alternatively, the speech acquisition process may continue until the control mechanism is actuated a second time. Audio output 160 may include at least one speaker, digital-to-analog (D/A) converter and DSP circuitry to receive digitized speech, via bus 106 from processor 110 and processor memory 120, convert the digitized speech to an analog signal, and broadcast the analog speech signal through the speaker. In a further embodiment, a piercing auditory alarm signal may be intermittently combined with the digitized speech signal, or, alternatively, with the analog speech signal.

In another embodiment, the functions of the A/D, DSP and D/A circuitry may be provided on a single chip or device, such as, for example, an ISD2532 Single Chip Voice Record/Playback Device (manufactured by Winbond Electronics Corp. of San Jose, Calif.), the Sanyo LC75010W Audio DSP (manufactured by SANYO Electric Co., Ltd. of Tokyo, Japan), etc. In this embodiment, audio input 150 may include the microphone and the single-chip voice record/playback device, which may include on-chip memory (e.g., audio memory 155) to store the digitized speech, while audio output 160 may include the speaker and associated amplification circuitry, which may include volume control. Control switch 104 may be coupled to processor 110, or alternatively, directly to the single-chip voice record/playback device.

In this embodiment, the speech acquisition process may be initiated by activating control switch 104, and the analog speech signal may be input to the single-chip voice record/playback device via the microphone, converted to digitized speech and then stored in on-chip memory. When a play signal is received from processor 110 via bus 106, the single-chip voice record/playback device may retrieve and convert the digitized speech to an analog speech signal, and send the analog speech signal to audio output 160, which may broadcast the analog speech signal through the speaker. In another embodiment, the single-chip voice record/playback device may reproduce telephone-quality voice, using, for example, 8-bit samples, an 8 kHz sampling frequency and a 3.4 kHz filter pass band. Other embodiments may reproduce higher-resolution voice using higher sampling rates, increased sampling resolution, broader filter pass bands, etc.

Additionally, interlock device 102 may be coupled to processor 110 (or, e.g., the single-chip voice record/playback device) to prevent activation of the speech acquisition process caused by accidental activation of control switch 104. Generally, interlock device 102 may be mechanical, electrical, electro-mechanical, etc. In an embodiment, interlock device 102 may be a shorting plug adapted to engage a shorting plug receptacle. When the shorting plug is engaged with the receptacle, activation of control switch 104 may trigger the speech acquisition process. Similarly, when the shorting plug is disengaged from the shorting plug receptacle, activation of control switch 104 may be prevented from triggering the speech acquisition process. Instead, when the shorting plug is disengaged from the shorting plug receptacle, activation of control switch 104 may trigger at least one playback of the stored, personal alert message.

In a further embodiment, audio input 150 may include an audio-frequency wireless receiver to receive an audible alarm signal, tone, etc. For example, audio input 150 may include an amplifier and level detection circuit, coupled to the microphone and processor 110. An audio-frequency alarm signal, for example, the piercing, audible alarm emitted by standard detector 180, may be input to the microphone and provided to the amplifier and level detection circuit in audio input 150. The amplifier and level detector circuit may include, for example, a voltage level comparator, such as an NJM2406 Single Comparator, manufactured by New Japan Radio Co., Ltd. of Tokyo, Japan), an analog signal level detector integrated circuit (IC), etc. If the detected analog signal level exceeds a predetermined threshold, an alert signal may be sent to processor 110 via bus 106.

In another embodiment, vibration actuator 170 may vibrate in response to a vibratory alarm signal sent, via bus 106, from processor 110. In one embodiment, vibration actuator 170 may be rigidly mounted to the housing of personal alarm device 100, and may include an electric motor with an unbalanced shaft. In response to the vibratory alarm signal, which may be a simple voltage level, digital word, etc., the motor may spin the shaft to induce an oscillating force, i.e., a vibration, to the housing. In an alternative embodiment, vibration actuator 170 may be enclosed within a separate housing, external to personal alarm device 100. In this embodiment, vibration actuator 170 may be coupled to personal alarm device 100, for example, via a wire or wires, an infrared communications link, a radio communications link, etc. For wireless links, additional circuitry, and a power supply, may be included within the housing of vibration actuator 170. In one embodiment, light 175 may be a strobe light, while in another embodiment, light 175 may be a combination of a low voltage light (e.g., 4 W night light) and a strobe light.

Generally, standard detector 180 and wireless detector 192 may include the appropriate sensor(s), microcontroller (s) and power supply to detect various noxious and/or toxic gases (e.g., smoke, $CO_2$, CO, methane, propane, NOx, etc.) or dangerous conditions (e.g., heat, flame, water, etc.). Standard detector 180 may be any commercial smoke detector, such as, for example, a First Alert® Double Sensor™ Smoke Detector (manufactured by BRK Brands, Inc. of Aurora, Ill.). Standard detector 180 may provide an alarm signal, typically in the form of a piercing audible alarm and/or flashing strobe light. Wireless detector 192 may be a wireless smoke, gas, heat and/or flame detector, similar to, for example, the Visonic MCT-423 Wireless Smoke Detector (manufactured by Visonic Ltd. of Tel-Aviv, Israel).

Wireless detector 192 may include a radio-frequency (RF) transmitter and supporting electronics to broadcast an RF alarm message within a frequency band in harmony with local regulations, such as, for example, 315 MHz, 404 MHz, 433 MHz, 900 MHz, 2.4 GHz, 5.8 GHz, etc. Other wireless transmission media may also be used, such as, for example, diffuse infra red (IR). Wireless detector 192 may operate independently, or, alternatively, wireless detector 192 may be an integrated component of wireless security system 190, such as, for example, the PowerMax™ system manufactured by Visonic Ltd. In one embodiment, wireless detector 192 may broadcast a single RF alarm message (e.g., a one shot) in response to the dangerous condition, such as, for example, a developing fire. In another embodiment, wireless detector 192 may broadcast a repetitive RF alarm message at a constant interval, such as, for example, every 10 seconds. The alarm message may be a simple sequence of bits, including a detector identifier as well as optional alarm identifier, checksum, etc., encoded, for example, in pulse width modulation format. Similar to standard detector 180, wireless detector 192 may optionally provide one or more additional alarm signals, such as, for example, a piercing audible alarm, a flashing strobe light, etc.

In one embodiment, wireless detector 192 may transmit the alarm message directly to personal alarm device 100, while in another embodiment, wireless detector 192 may transmit an initial alarm message to wireless security system control panel 194 such as, for example, the PowerMax™ PowerCode™ Wireless Control Panel. In the latter embodiment, wireless security system control panel 194 may then transmit a final alarm message to personal alarm device 100. In this manner, wireless security system control panel 194 may determine whether the initial alarm message received from wireless detector 192 is a false alarm based on other considerations, such as, for example, other wireless security system component indicators. Advantageously, any wireless security system alert status may trigger the transmission of the final alarm message from wireless security system control panel 194 to personal alarm device 100.

Remote wireless module 185 may include an RF transmitter, antenna, supporting electronics and power supply, and may be mounted within, or proximate to, standard detector 180. In an embodiment, the RF transmitter may be an integrated, transmitter-encoder module, such as, for example, a Linx TXD-418-KH Transmitter/Encoder, etc. In one embodiment, remote wireless module 185 may be coupled to the internal alarm signal of standard detector 180, and, upon detection of the internal alarm signal produced by standard detector 180, may transmit an RF alarm message to personal alarm device 100. In another embodiment, remote wireless module 185 may be located proximate to standard detector 180 and may include appropriate audio circuitry (e.g., microphone, amplifier circuitry and level detector) to detect the piercing audible alarm signal, and, in response, transmit the RF alarm signal to personal alarm device 100.

Figure 2:
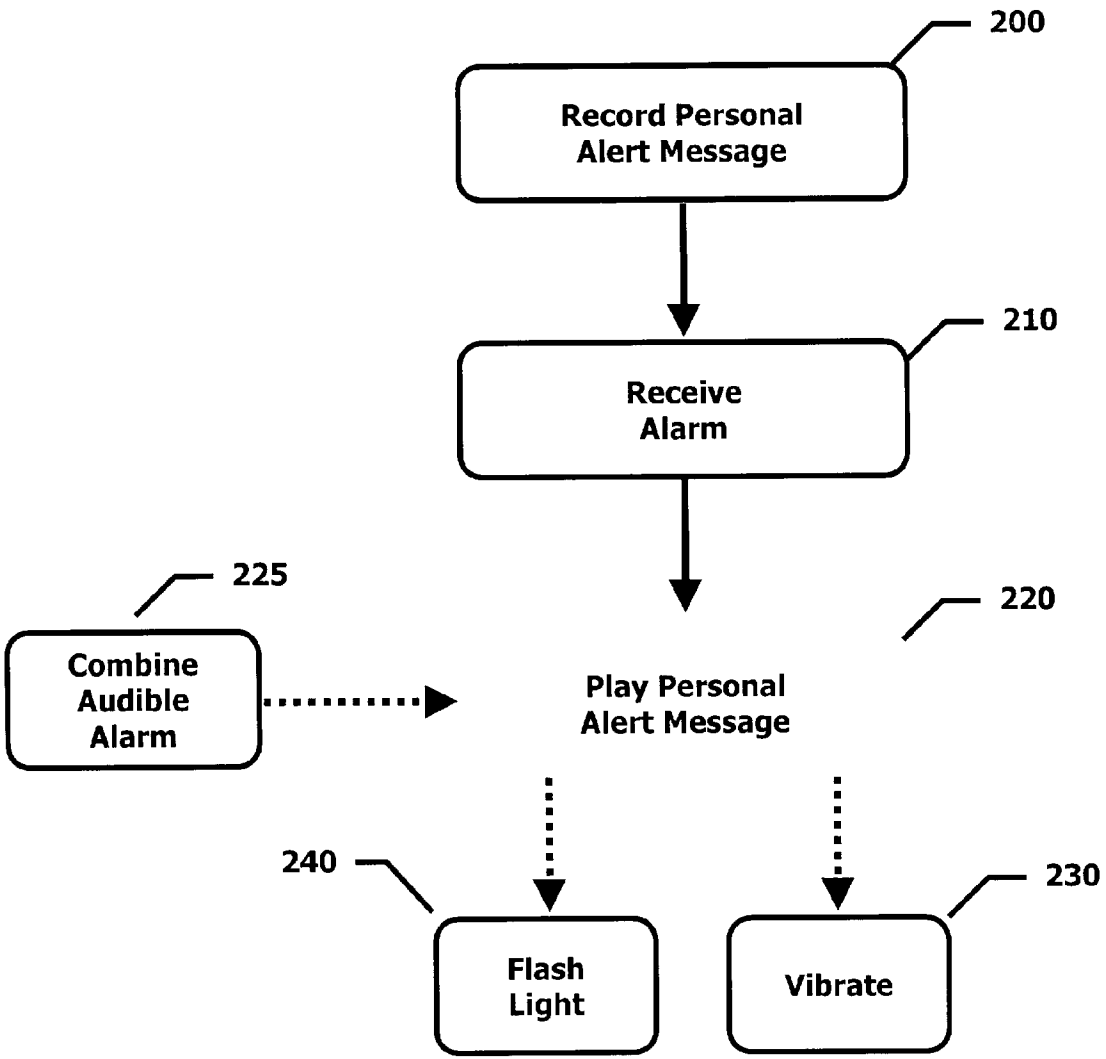
FIG. 2 is a flow chart depicting a method for alerting a quiescent person, according to an embodiment of the present invention.

FIG. 2 presents a flow chart depicting a method for alerting a quiescent person to the presence of dangerous gases, according to an embodiment of the present invention.

A personal alert message may be recorded (200). In one embodiment, a spoken, personal alert message may be recorded (200) by audio input 150. In this embodiment, the spoken, personal alert message may be received and digitized by audio input 150, and then stored within audio memory 155. In another embodiment, the spoken, personal alert message may be recorded (200) by a combination of audio input 150, processor 110 and processor memory 120. In this embodiment, the spoken, personal alert message may be received and digitized by audio input 150, and then sent to processor 110 for storage within processor memory 120. Advantageously, the spoken, personal alert message may be specifically applicable, i.e., personal, to the quiescent person. For example, a person's own name occupies a privileged status in the cognitive processing of external information within the brain. In other words, the sound of a person's own name has a greater stimulating effect on the sleep/wake centers of the brain than other audible stimuli. In one embodiment, the quiescent person may be a sleeping child, and the personal alert message may be recorded by the child's parent, sibling, grandparent, guardian, etc. The personal alert message may include the child's name, and/or other important information or exhortations, such as, for example, "Johnny, Wake Up!" In another embodiment, the quiescent person may be a senior citizen, and the personal alert message may be spoken by the spouse, child, relative, etc., of the senior citizen.

An alarm may be received (210). In one embodiment, radio-frequency receiver 140 may send an alert signal to processor 110 indicating that an RF alarm message has been received (210), while in another embodiment, audio input 150 may send an alert signal to processor 110 indicating that an audio-frequency alarm signal (i.e., audible alarm) has been received (210). In a further embodiment, radio-frequency receiver 140 and audio input 150 may each send alert signals to processor 110, based on the reception (210) of an radio-frequency alarm signal and an audio-frequency alarm signal, respectively. Advantageously, processor 110 may reduce the risk of false alarms by determining whether an emergency condition actually exists using various criteria, such as, for example, requiring both alert signals to be received within a predetermined time period, always requiring an alert signal from radio-frequency receiver 140, etc.

In one embodiment, processor 110 may send a play signal to audio input 150, which may convert the digitized personal alert message, stored in audio memory 155, to an analog audio signal, and then send the analog audio signal to audio output 160 to be played (220). In another embodiment, processor 110 may transfer the digitized personal alert message from processor memory 120 to audio output 160, which may then convert the digitized personal alert message to an analog audio signal. The analog audio signal may then be played (220).

In a further embodiment, a piercing, audible alarm may be combined (225) with the recorded, personal alert message. For example, a standard detector audible alarm may be temporally combined (225) with the personal alert message, so that the standard detector alarm alternates with the personal alert message. In one embodiment, the two signals may be combined (225) by audio input 150, in either the digital or analog domain, and then sent to audio output 160, while in another embodiment, the two signals may be combined (225), digitally, by processor 110 and sent to audio output 160. In a further embodiment, audio output 160 may combine (225) the personal alert message with a standard detector alarm, in either the digital or analog domain. Generally, personal alarm device 100 may be placed so that the quiescent person hears the personal alert message.

In another embodiment, processor 110 may also send a vibratory alarm signal to vibration actuator 170 in response to the alarm signal from radio-frequency receiver 140 or audio input 150. In response, vibration actuator 170 may vibrate (230) for a predetermined period of time, or, alternatively, until a mechanical control, such as, for example, control switch 104, is actuated on personal alarm device 100. In a further embodiment, vibration actuator 170 may be housed separately from personal alarm device 100, and may include a mechanical control, for example, a button, a switch, etc., to cease vibration, as well as to test the vibration actuator. Vibration actuator 170 may be placed so that the quiescent person senses the vibration. For example, vibration actuator 170 may be attached to a wristband, a child's toy (e.g., a stuffed animal or teddy bear), a pillow, a bed, a mattress, etc.

In a further embodiment, processor 110 may also send a visual alarm signal to light 175 in response to the alarm signal from radio-frequency receiver 140 or audio input 150. In response, light 175 may flash (240) for a predetermined period of time, or, alternatively, until a mechanical control, such as, for example, control switch 104, is actuated on personal alarm device 100. In another embodiment, light 175 may be housed separately from personal alarm device 100, and may include a mechanical control, e.g., button, switch, etc., to cease activation, as well as to test the light. Light 175 may be placed so that the quiescent person senses the visual cue. For example, light 175 may be attached to a headboard, a child's toy (e.g., the eyes of a stuffed animal or teddy bear), etc.

Several embodiments of the present invention are specifically illustrated and described herein. However, it will be appreciated that modifications and variations of the present invention are covered by the above teachings and within the purview of the appended claims without departing from the spirit and intended scope of the invention.

What is claimed is:

1. A method for alerting a quiescent person, comprising:

providing written instructions to record a personal alert message, the personal alert message to contain a recording selected to alert a predetermined quiescent person;

providing a remote wireless module, the remote wireless module configured to sense an audible signal and send an alarm over a wireless communications link, the alarm generated to trigger playing a personal alert message; and providing a device to receive an alarm from the remote wireless module over a wireless communications link;

wherein the device, in response to the alarm, plays a vocal personal alert message.

2. The method of claim 1, wherein the communications link is a wireless radio-frequency communications link.

3. The method of claim 1, wherein the audible alarm is generated by a smoke detector.

4. The method of claim 1, wherein the provided device further comprises a vibration actuator which vibrates in response to receiving the alarm.

5. The method of claim 1, wherein the provided device further comprises a strobe light which flashes in response to receiving the alarm.

6. The method of claim 1, further comprising combining an audible alarm with the personal alert message, the recording including the name of the predetermined quiescent person.

7. A system for alerting a quiescent person, comprising:

an audio input to record a personal alert message;

a memory storing a personal alert message, the stored personal alert message selected to alert a predetermined quiescent person;

an audio output to play the personal alert message;

a wireless receiver configured to sense an audible signal from an alarm condition detector and send an electronic signal over a wireless communications link;

a power supply; and a processor, coupled to the audio input, the audio output, the memory, and the power supply, the processor configured to:

receive a wireless alert signal from the wireless receiver, and in response to the alert signal, send a play signal to play a vocal personal alert message.

8. The system of claim 7, wherein the wireless receiver detects radio frequencies.

9. The system of claim 7, wherein the stored personal alert message includes the name of the preselected quiescent person.

10. The system of claim 7, wherein the stored personal alert message is recorded by a relative of the preselected quiescent person.

11. The system of claim 7, wherein the stored personal alert message is the preselected quiescent person's name followed by an instruction.

12. The system of claim 7, wherein the audio input includes a digital voice recorder/player.

13. The system of claim 12, wherein the processor sends the play signal to the digital voice recorder/player.

14. The system of claim 7, wherein the processor sends the play signal to the audio output.

15. The system of claim 7, further comprising a removable interlock to permit recording of the personal alert message when coupled to the processor.

16. The system of claim 7, further comprising a strobe light coupled to the processor and responsive to a visual alarm signal from the processor.

17. The system of claim 7, further comprising a vibration actuator coupled to the processor and responsive to a vibratory alarm signal from the processor.

18. The system of claim 17, wherein the processor is attached to a wristband.

19. The system of claim 17, wherein the processor is installed within a stuffed animal.

20. The system of claim 17, wherein the processor is installed within a pillow.

21. The system of claim 17, wherein the processor is installed within a mattress.

22. The system of claim 17, wherein the processor is attached to a bed frame.

* * * * *